US011174598B2

(12) United States Patent
Auer

(10) Patent No.: US 11,174,598 B2
(45) Date of Patent: Nov. 16, 2021

(54) METHOD AND TRACK MAINTENANCE MACHINE FOR CORRECTION OF TRACK POSITION ERRORS

(71) Applicant: PLASSER & THEURER EXPORT VON BAHNBAUMASCHINEN GESELLSCHAFT M.B.H., Vienna (AT)

(72) Inventor: Florian Auer, Vienna (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 360 days.

(21) Appl. No.: 16/347,632

(22) PCT Filed: Oct. 9, 2017

(86) PCT No.: PCT/EP2017/001187
§ 371 (c)(1),
(2) Date: May 6, 2019

(87) PCT Pub. No.: WO2018/082798
PCT Pub. Date: May 11, 2018

(65) Prior Publication Data

US 2019/0316300 A1 Oct. 17, 2019

(30) Foreign Application Priority Data

Nov. 4, 2016 (AT) ..... A 504/2016

(51) Int. Cl.
*E01B 29/04* (2006.01)
*E01B 27/17* (2006.01)
*E01B 35/08* (2006.01)

(52) U.S. Cl.
CPC ..... *E01B 29/04* (2013.01); *E01B 27/17* (2013.01); *E01B 35/08* (2013.01); *E01B 2203/10* (2013.01)

(58) Field of Classification Search
CPC ..... E01B 29/04; E01B 27/17; E01B 35/08; E01B 2203/10
See application file for complete search history.

(56) References Cited

U.S. PATENT DOCUMENTS 4,528,912 A * 7/1985 Hansmann ..... E01B 27/18 104/11
5,257,579 A * 11/1993 Theurer ..... E01B 27/20 104/2

(Continued)

FOREIGN PATENT DOCUMENTS

CN 2036546 U 4/1989
CN 1062570 A 7/1992

(Continued)

*Primary Examiner* — Jason C Smith
(74) *Attorney, Agent, or Firm* — Laurence A. Greenberg; Werner H. Stemer; Ralph E. Locher

(57) ABSTRACT

A method for the correction of vertical position error of a track by a track tamping machine and a dynamic track stabilizer. Starting from a registered actual position, an over-lift value is prescribed for a treated track location with which the track is lifted into a preliminary over-lift track position and tamped. The track is subsequently lowered by dynamic stabilization into a resulting final track position. In this, a smoothed actual position course is formed from a course of the actual track position, wherein an over-lift value is prescribed for the treated track location in dependence of the course of the actual track position with regard to the smoothed actual position course. In this way, only short-wave track faults are treated with an over-lift value.

12 Claims, 2 Drawing Sheets

(56) References Cited

U.S. PATENT DOCUMENTS

| | | | | | |
|---|---|---|---|---|---|
| 6,154,973 | A * | 12/2000 | Theurer | ..... | E01B 27/17 104/12 |
| 6,260,485 | B1 * | 7/2001 | Theurer | ..... | E01B 35/00 104/7.2 |
| 8,113,120 | B2 * | 2/2012 | Theurer | ..... | E01B 27/17 104/2 |
| 2019/0316300 | A1 * | 10/2019 | Auer | ..... | E01B 27/17 |
| 2020/0354899 | A1 * | 11/2020 | Auer | ..... | E01B 35/08 |

FOREIGN PATENT DOCUMENTS

| | | | |
|---|---|---|---|
| CN | 1030788 | C | 1/1996 |
| CN | 1231360 | A | 10/1999 |
| CN | 1263184 | A | 8/2000 |
| CN | 2703784 | Y | 6/2005 |
| CN | 101027449 | A | 8/2007 |
| CN | 101061275 | A | 10/2007 |
| DE | 3236722 | A1 | 8/1983 |
| EP | 1028193 | A1 | 8/2000 |
| EP | 1817463 | B1 | 9/2008 |
| WO | 9514817 | A1 | 6/1995 |

* cited by examiner

METHOD AND TRACK MAINTENANCE MACHINE FOR CORRECTION OF TRACK POSITION ERRORS

FIELD OF TECHNOLOGY

The invention relates to a method for correction of vertical position errors (faults) of a track by means of a track tamping machine and a dynamic track stabilizer, wherein—starting from a registered actual track position—an over-lift value is prescribed for a treated track location with which the track is lifted into a preliminary over-lift track position and tamped and is subsequently lowered by means of dynamic stabilization into a resulting final track position. The invention additionally relates to a track maintenance machine for executing the method.

PRIOR ART

According to EP 1 817 463 A1, a method for correction of vertical position errors of a track having a ballast bed is known, wherein said track—while being lifted into a preliminary target position—is tamped and subsequently, in the course of a track stabilisation by applying a static vertical load in connection with transverse vibrations, is at last lowered in a controlled way into a final target position.

In this, during lifting and tamping, a super-elevation of the track which is specific in relation to the vertical position errors is prescribed in order to be able to more severely compact by means of the subsequent track stabilisation those track sections which have greater vertical position errors. This is intended to counteract a rapid sinking into the old faulty track position due to traffic impact.

The known method is usually called "Design Overlift", wherein a particular overlift value is prescribed on the basis of empirical data. As becomes clear from FIG. 2, individual errors can thus be corrected sustainably. However, with this approach there is an unnecessarily great super-elevation in some treatment zones which is connected with an increased ballast demand.

SUMMARY OF THE INVENTION

It is the object of the invention to provide an improvement over the prior art for a method of the type mentioned at the beginning. Also, a corresponding track maintenance machine is to be described.

According to the invention, these objects are achieved by way of a method as claimed and a track maintenance machine as claimed. Dependent claims indicate advantageous embodiments of the invention.

In this, it is provided that a smoothed actual position course is formed from a course of the actual track position, and that an over-lift value is prescribed for the treated track location in dependence of the course of the actual track position with regard to the approximately smoothed actual position course.

In this manner, only short-wave track errors are treated with an overlift value. Long-wave settlements of the track, on the other hand, are represented in the smoothed actual position course and remain hidden when the overlift value is prescribed. In this, the overlift value is either computed continuously for the treated track location, or updated in prescribed intervals.

In an advantageous further development, after dynamic stabilization has taken place, residual error values are detected by means of a re-measuring system, wherein the over-lift value for the currently treated track location is prescribed in dependence on at least one residual error value. With this iterative adaptation of the track super-elevation, an optimisation occurs while taking into account the conditions present in the track.

A favourable method for determining the smoothed actual position course consists of filtering the course of the actual track position by means of a low-pass filter. With this, the smoothed actual position course can be derived continuously from the detected course of the actual track position. Alternatively, via a prescribed averaging length, a sliding mean value can be determined as a smoothed actual position course.

On the basis of a stored course of the actual track position, it is advantageous if, by means of the smoothed actual position course, local maximums of the stored course of the actual track position are determined. In this manner, connecting said maximums yields a precise position curve for the long-wave settlements of the track.

In this, it is often sufficient if a polygon is formed which connects local maximums of the stored course of the actual track position. This method requires little computing power and allows a particularly swift adapting of the overlift value.

In addition, it is advantageous if a wave-length for the vertical position errors is determined from the course of the actual track position, and if the overlift value is prescribed also in dependence on the wave-length. With this, the overlift value can be adapted to the ballast condition, because a worse ballast condition usually causes vertical position errors with shorter wave-lengths.

A further improvement of the method according to the invention provides that a deviation value for the treated track location is determined from the course of the actual track position with regard to the approximately smoothed actual position course and that, as overlift value, the deviation value is multiplied by an overlift factor. The deviation value is not, as customary until now, a deviation relative to a target track course but rather a relative value with regard to the smoothed actual position course. Thus, there is an efficient determining of the current overlift value.

In further sequence, it is useful if the overlift factor is adapted iteratively while taking into account a residual error value of the track detected after dynamic stabilisation has taken place. Thus, a continuous adapting of the overlift factor takes place automatically in dependence on the conditions prevalent in the track.

For detecting the residual error values, it is advantageous if the same takes place at track locations with a local minimum of the course of the original actual track position. Since, at such locations, the locally greatest overlifts take place, the corresponding residual error values are particularly meaningful for the correct degree of the respective overlift.

In a simple variant of embodiment, it is provided that the residual error value detected at a track location and the overlift value applied at this track location are added up, and that—for prescribing a new overlift factor—the deviation value originally present at this track location is divided by this sum.

An optimisation of the overlift adaptation takes place by mean value formation, wherein several residual error values detected one after the other are used for determining the new overlift factor. Thus, possible mistakes are equalized which can occur on the basis of malfunctions in the case of individual computations of the overlift factor.

A track maintenance machine, according to the invention, for correction of vertical position errors of a track includes a track tamping machine and a track stabilizer coupled thereto. In this, an evaluation device and a control device are provided which are configured for executing the described method.

BRIEF DESCRIPTION OF THE DRAWINGS

The invention will be described by way of example below with reference to the attached figures. There is shown in schematic representation in.

DESCRIPTION OF THE EMBODIMENTS

Figure 1:
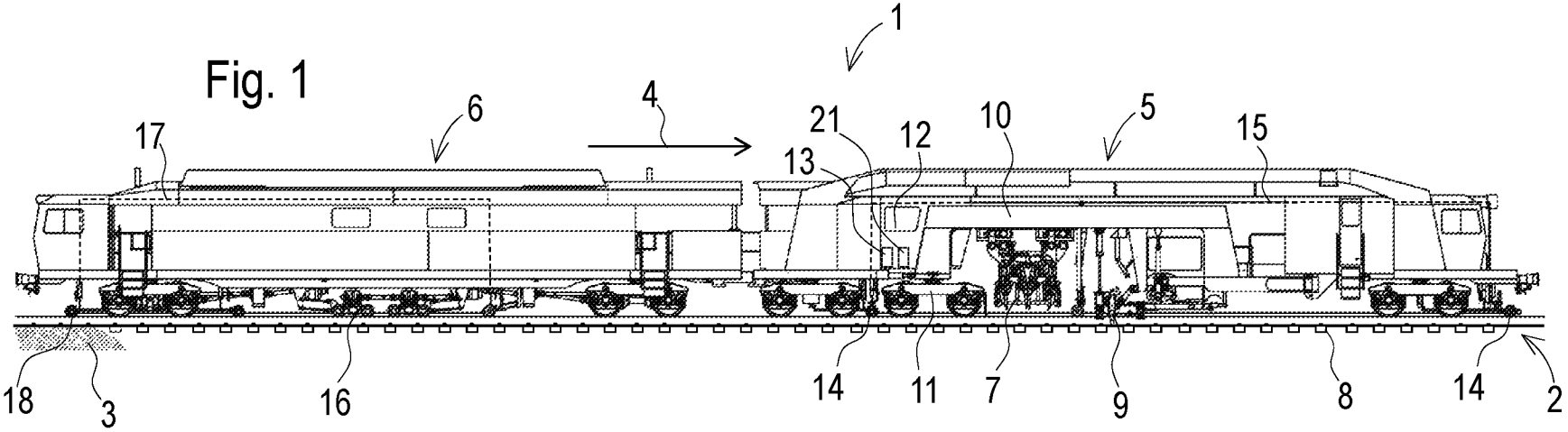
FIG. 1 a track tamping machine with a dynamic track stabilizer

The track maintenance machine 1 shown in FIG. 1 is intended for a correction of vertical position errors of a track 2 resting in the ballast bed 3. In this, a track tamping machine 5 situated at the front in the working direction 4 is coupled to a dynamic track stabilizer 6.

The track tamping machine 5 comprises a tamping unit 7 for tamping sleepers 8, and a track lifting unit 9 located in front. Both units 7, 9 are arranged on a common satellite frame 10. At a front end, the latter is mounted for longitudinal displacement in a machine frame and supported at a rear end on a separate rail undercarriage 11.

Arranged above the same is a work cabin 12 with a control device 13. For the correction of vertical position errors of the track 2, a reference system 15 having measuring axles 14 is provided. With this, the course of the actual track position I is determined. Alternatively, a measuring run by means of a separate measuring car can take place, with subsequent transmission of the measurement data to the machine 1.

The dynamic track stabilizer 6 comprises stabilizing units 16 which can be pressed upon the track 2 with a vertical load and simultaneously set the track in transverse vibrations. For check measurement of the resulting final track position R, a separate re-measuring system 17 with measuring axles 18 is provided.

Figure 2:
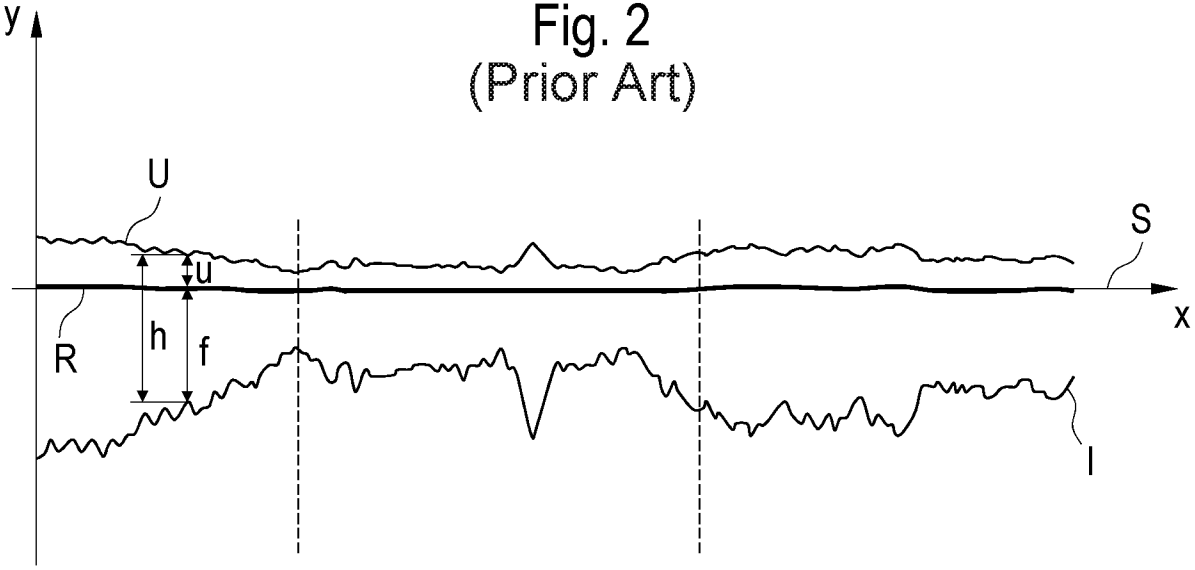
Fig. 2 (Prior Art)
FIG. 2 a diagram of the track position according to the prior art

Shown in FIG. 2 are the track position courses which change during tamping and stabilizing within the scope of the known "Design Overlift". In this, the extension of the track 2 in the working direction 4 is indicated in the x-axis, and the respective vertical position of the track 2 is indicated in the y-axis. For example, in the case of a level track section, a target track position S extends in the x-axis, with a vertical deviation equalling zero.

With regard to the target track position S, the detected actual track position I has vertical error values f of varying magnitude. Up to now, it has been customary for tamping a track 2 to prescribe an overlift value u correlating to the respective error value f. Set as a specific lifting value h was the error value f plus the correlating overlift value. The result was a temporary overlift track position U. By means of the dynamic track stabilizer 6, a lowering into a final track position R took place subsequently.

Figure 3:
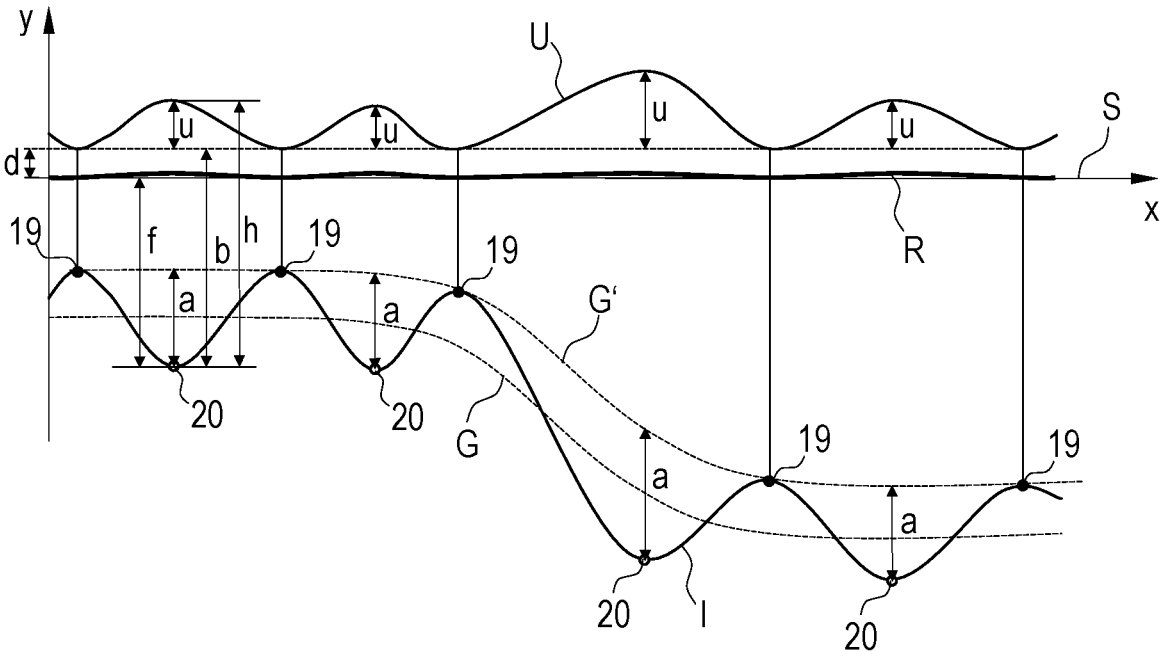
FIG. 3 a diagram of the track position according to the present invention

With the method according to the invention, first a smoothed actual position course G of the track 2 is formed. In FIG. 3, the track position courses I, S, R, U according to FIG. 2 are also shown. By means of a low-pass filter, the smoothed actual position course G is determined from the course of the actual track position I. A variant provides that a sliding mean value is determined as smoothed actual position course G via a pre-set averaging length (for example, 30 m).

All of the upper turnaround points of the course of the actual track position I which lie above the smoothed actual position course G are recognized as local maximums 19. With this point cloud, it is possible to determine a curve function by means of which a curve G' connecting the local maximums 19 can be described. Alternatively, the smoothed actual position course G can be shifted in the direction of the local maximums 19, so that the displaced curve G' approximately connects the local maximums 19.

In a further method step, deviation values a are determined as difference values between the course of the actual track position I and the curve G' connecting the maximums 19. With an overlift factor c, this results in the overlift values u by multiplication:

$$u=c\cdot a$$

Consequently, there are no overlift values at the track locations with deviation values a equalling zero (local maximums of the course of the actual track position I). Here, the track is lifted with a basic lifting value b which is required for attaining the target track position S. In this, the error value f known from the survey of the track 2 is added to a sinking value d occurring during stabilizing:

$$b=f+d$$

For the other track locations, an overlift value u according to the above-shown formula ensues. In this, the greatest overlift values u occur at track locations with a local minimum 20 in the course of the actual track position I. In total, a lifting value h thus results as the sum of the basic lifting value b and the overlift value u:

$$h=b+u$$

Figure 4:
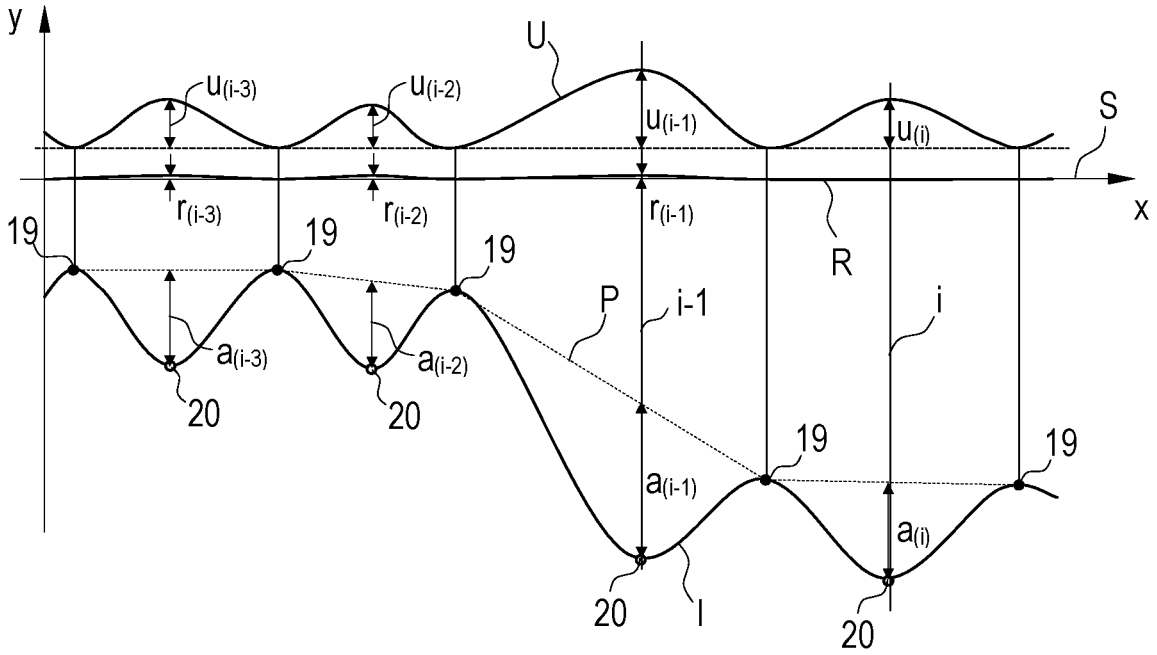
FIG. 4 a diagram with a polygon

A simplified determination of the deviation values a is shown in FIG. 4. In this, the maximums 19 of the course of the actual track position I are connected by a polygon P. The individual deviation values a ensue as the difference between the course of the actual track position I and the polygon P.

The resulting final track position R after stabilizing has taken place can be used to optimize the overlift factor c. Only at the start of the method, an overlift factor c derived from empirical data is prescribed. Thereafter, an iterative adaptation takes place.

As can be seen in FIG. 4, the method uses residual error values r, measured at local minimums 20 of the course of the actual track position I, which lie behind a currently treated track location i with respect to the working direction 4. In this, detection takes place by means of the re-measuring system 17. For computation of the overlift $u_{(i)}$ at the treated track location i, the overlift factor $c_{(i)}$ is prescribed as follows:

$$c_{(i)}=a_{(i-1)}/u_{(i-1)}+r_{(i-1)})$$

If a positive residual error value $r_{(i-1)}$ remains, then the overlift factor $c_{(i)}$ is automatically reduced, and the following overlifting $u_{(i)}$ turns out smaller. However, if the track 2 sinks below the target track position S during stabilization, then the overlift value $u_{(i)}$ increases for the following treatment intervals.

An ideal overlift factor $c_{(i)}$ is computed by mean value formation over several track position waves and prescribed to the track tamping machine 5 as a new overlift factor $c_{(i)}$.

For example, the following formula with several residual error values $r_{(i-1)}$, $r_{(1-2)}$, $r_{(1-3)}$ is applied:

$$c_{(i)}=((a_{(i-1)}/(u_{(i-1)}+r_{(i-1)}))+(a_{(i-2)}/(u_{(i-2)}+r_{(i-2)}))+(a_{(i-3)}/(u_{(i-3)}+r_{(i-3)})))/3$$

The track maintenance machine 1 comprises an evaluation device 21 which is designed for the above-explained calculations. This is, for example, an industrial computer. The values of the actual track position I and of the resulting final track position R are fed to the evaluation device 21 in order to determine from this in real time the overlift value $u_{(i)}$. In addition, currently calculated values $c_{(i)}$, $u_{(i)}$ can be shown to a machine operator by means of a display unit. In this, it is possible to emit a warning signal in the event of erratic changes of the calculated overlift factor $c_{(i)}$.

A further improvement for adapting the overlift factor $u_{(i)}$ can be achieved by inclusion of a detected wavelength of the vertical position errors. Normally, this is between 10 m and 12 m. In a track 2 with poor ballast condition, however, track position errors with a wavelength between 5 m and 6 m develop.

The improved method provides that first the wavelength is determined from the actual track position, and then the overlift value $u_{(i)}$ is adjusted in dependence of the wavelength. In the case of a shorter wavelength, for example, the overlift factor $c_{(i)}$ is increased in order to counteract a likely re-sinking of the track 2 at track locations i with poor ballast condition.

The invention claimed is:

1. A method of correcting vertical position faults of a track, the method comprising:

measuring an actual track position;

forming a smoothed actual position course from a course of the actual track position;

starting from the actual track position, prescribing an over-lift value for a given track location that is being treated, the over-lift value being dependent on the course of the actual track position relative to the smoothed actual position course;

lifting the track into a preliminary over-lift track position defined by the over-lift value of the given track location and tamping the track with a track tamping machine; and subsequently lowering the track by dynamic stabilization with a dynamic track stabilizer into a resulting final track position.

2. The method according to claim 1, which comprises, subsequent to the dynamic stabilization, detecting residual fault values with a re-measuring system, and prescribing the over-lift value for a currently treated track location in dependence of at least one residual fault value.

3. The method according to claim 1, which comprises determining the smoothed actual position course from the course of the actual track position by way of a low-pass filter.

4. The method according to claim 1, which comprises determining local maxima of the course of the actual track position by way of the smoothed actual position course.

5. The method according to claim 4, which comprises forming a polygon which connects local maxima of the stored course of the actual track position.

6. The method according to claim 1, which comprises determining a wavelength for the vertical position faults from the course of the actual track position, and prescribing the overlift value also in dependence on the wavelength.

7. The method according to claim 1, determining a deviation value for the given track location from the course of the actual track position with regard to the smoothed actual position course and forming the overlift value by multiplying the deviation value by an overlift factor.

8. The method according to claim 7, which comprises iteratively adapting the overlift factor while taking into account a residual fault value of the track detected after the dynamic stabilization has taken place.

9. The method according to claim 8, which comprises detecting the residual fault value is detected at a track location with a local minimum of the course of the original actual track position.

10. The method according to claim 9, which comprises adding the residual fault value detected at a track location and the overlift value applied at the track location to form a sum value, and, for prescribing a new overlift factor, dividing the deviation value originally present at this track location by the sum value.

11. The method according to claim 10, which comprises using several residual fault values detected one after another for determining the new overlift factor.

12. A track maintenance machine for correction of vertical position errors of a track, the track maintenance machine comprising:

a track tamping machine for lifting and tamping the track; and a dynamic track stabilizer for dynamically stabilizing the track; and an evaluation device and a control device configured for executing the method according to claim 1.

* * * * *